United States Patent [19]

Ashley

[11] Patent Number: 4,932,576

[45] Date of Patent: Jun. 12, 1990

[54] POUCH ASSEMBLY FOR CARPENTERS AND OTHER TRADESMEN

[76] Inventor: Jay C. Ashley, 1718 Linden Ave., Burlingame, Calif. 94010

[21] Appl. No.: 249,312

[22] Filed: Sep. 26, 1988

[51] Int. Cl.[5] ..... A45F 5/00

[52] U.S. Cl. ..... 224/253; 224/226; 224/231; 224/235; 224/240; 224/272; 224/269; 224/904; 224/901; 383/33; 383/23

[58] Field of Search ..... 224/253, 252, 270, 271, 224/272, 268, 269, 904, 226, 231, 235, 240, 901; 383/33, 38, 40, 22, 23, 24; 206/372, 373, 338

[56] References Cited

U.S. PATENT DOCUMENTS

| | | | |
|---|---|---|---|
| 1,113,590 | 10/1914 | Williamson . | |
| 1,270,158 | 6/1918 | Hill | 224/904 |
| 1,482,130 | 1/1924 | Griest . | |
| 1,751,229 | 3/1930 | Bigelow | 383/23 |
| 2,602,574 | 7/1952 | Mangold et al. | 224/272 |
| 2,618,419 | 8/1949 | Vanish | 224/252 |
| 3,172,583 | 3/1965 | Smith . | |
| 3,361,312 | 1/1968 | Hutchison | 224/252 |
| 4,079,767 | 3/1978 | Howard | 224/235 |
| 4,166,557 | 9/1979 | Conley | 224/253 |
| 4,226,105 | 10/1980 | Wehrman | 224/253 |
| 4,372,468 | 2/1983 | Harvey | 224/253 |
| 4,416,315 | 11/1983 | Foley | 224/252 |
| 4,638,530 | 1/1987 | Perry | 224/904 |
| 4,747,527 | 5/1988 | Trumpower . | |

FOREIGN PATENT DOCUMENTS

| | | | |
|---|---|---|---|
| 68573 | 6/1914 | Switzerland | 224/252 |

*Primary Examiner*—Linda J. Sholl

*Attorney, Agent, or Firm*—Thomas M. Freiburger

[57] ABSTRACT

A nail and screw pouch and tool holder assembly includes one or more slidable belt-attached pouch holders with slots through which a belt passes, worn by the user. Each pouch holder, which may be of leather so as to be relatively stiff, has a pouch hanger member formed of a generally horizontal rigid bar or rail with a plurality of depending U-shaped sections, each for supporting and locating a clip from which a pouch or tool holder hangs.

9 Claims, 1 Drawing Sheet

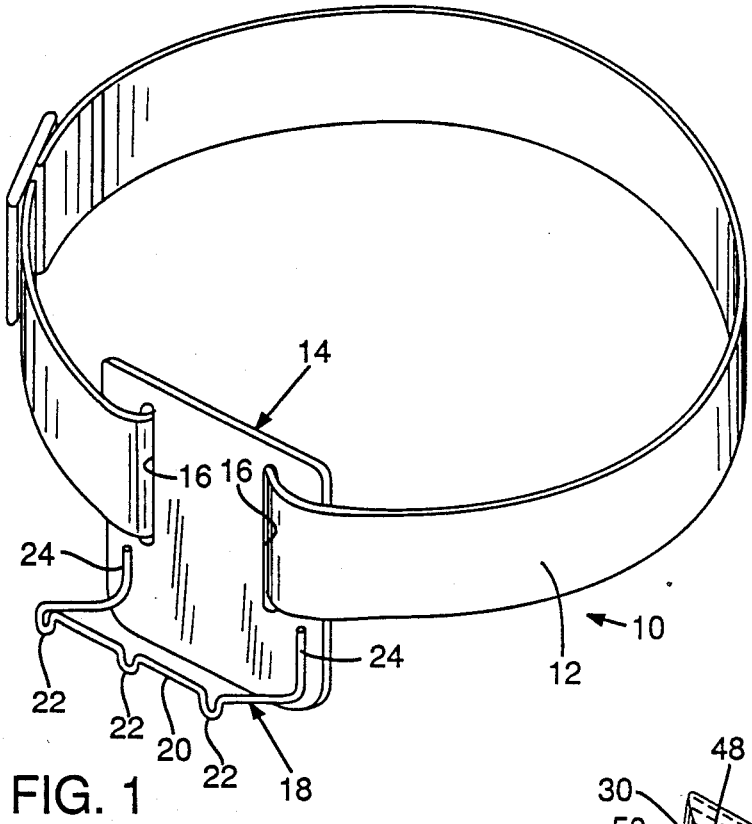
FIG. 1
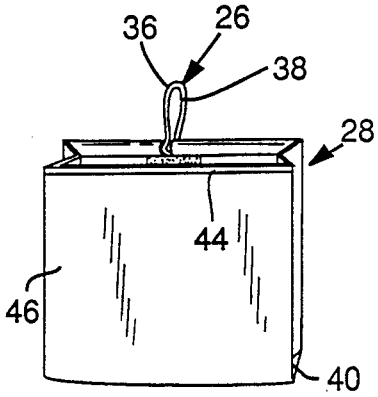
FIG. 3
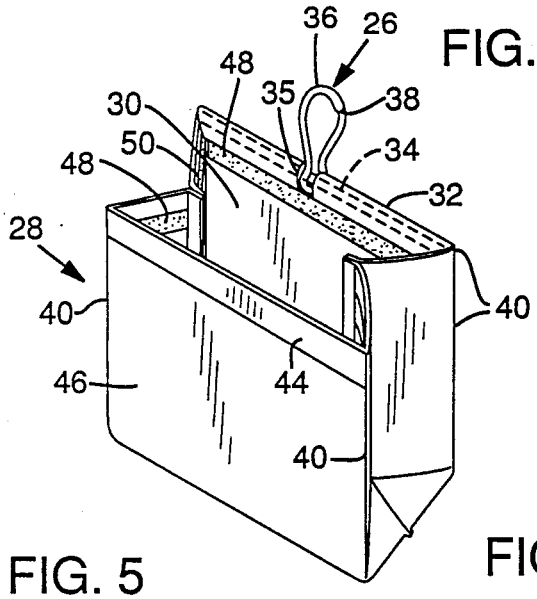
FIG. 2
FIG. 4
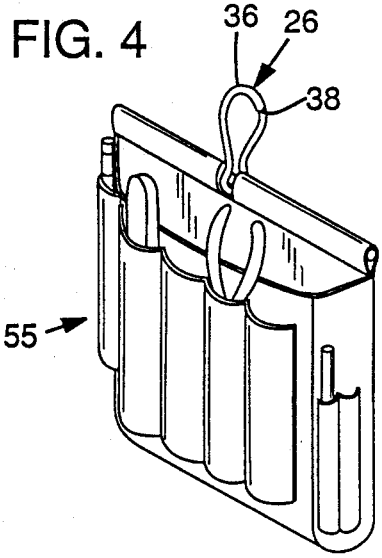
FIG. 5
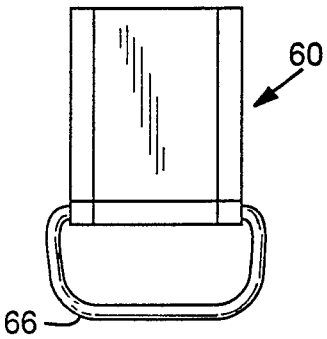
FIG. 6
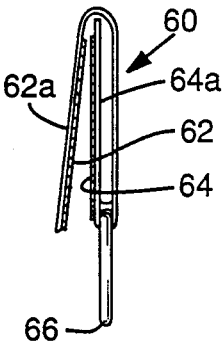

POUCH ASSEMBLY FOR CARPENTERS AND OTHER TRADESMEN

BACKGROUND OF THE INVENTION

The invention is in the field of tools and workpiece holding garments, and is particularly concerned with an improved belt-supported pouch or bag apparatus for conveniently and accessibly storing nails, screws and other items for a tradesman such as a carpenter or electrician, and also for carrying tools used by the tradesman.

Belt-supported pouches or bags for carrying nails, tacks, screws, bolts, etc. are well known. Generally such apparatus consist of a belt worn by the user, with a series of fixedly attached leather pouches positioned around the belt. Some of the belt devices have also had provision for carrying tools.

The following United States patents disclose generally belt apparatus for carrying items used by workers in various trades: U.S. Pat. Nos. 1,113,590, 1,207,158, 1,482,130, 3,172,583, 4,166,557, and 4,747,527. Most of these patents disclose various types of nail pouch or tool holder devices, most of which are attached to a belt by metal clips or fasteners. In some, the nail or screw pouches or bags are removable from the belt and interchangeable with other similar pouches as dictated by the needs of the user.

However, none of these patents shows a nail/screw pouch or bag apparatus having the efficient and advantageous features of the present invention described below.

SUMMARY OF THE INVENTION

In accordance with the belt-supported nail pouch or tool holder apparatus of the present invention, a belt worn by the user supports any of a series of different nail or screw pouches or bags, or tool holders, in a convenient manner which enables a pouch or tool holder to be quickly snapped onto the belt in a manner requiring very little attention of the user. A pouch holder member is connected to the belt and has a generally horizontal bar or rail with dips or U-shaped depending sections, each of which will hold and locate a hook of a pouch or tool holder attached to the bar. The preferably metal hook holding bar or bracket is configured so as to be spaced away slightly from the remainder of the pouch holder member, enabling a closable snap hook to be readily snapped over the bar to connect the hook onto the bar. The bracket or bar may be connected to the remainder of the pouch holder by generally vertical legs which give the bar or bracket twisting resistance when the weight of several pouches is hung on the bar.

The pouches or bags which form a part of the invention preferably are formed of a flexible material such as woven nylon, rather than the relatively stiff leather pouches which have been conventional. In preferred embodiments, the bags have an open mouth having generally two sides, which have patches of cooperating Velcro material, for closing the mouth of the bag an re-opening it conveniently. In one side of the bag's mouth there may be a substantially rigid rod, as of plastic, secured by a loop of the bag material extending over it and held by stitching, for example. This rod may support a base end of the closable snap type hook or "dog hook" or "Carribeaner hook" which enables the pouch or bag to be secured to the belt via the hanger bracket. Thus, the bag or pouch is supported from one side of its open mouth, so that when it is not secured in the closed position with the Velcro, it hangs open to provide easy access to the contents.

Also in preferred embodiments, the nylon fabric bag or pouch is constructed with seamed edges at its vertical corners, helping to hold the shape of the bag when it hangs in the open position.

The pouches or bags when removed from the rail of the belt apparatus are useful in storing nails or other items used by the tradesman. They can be packed in a tool box or bag supported on a special storing device, by their hooks.

As mentioned above, the apparatus of the invention may include a series of tool holders which are interchangeable with the nail/screw bags, so that on any of the hanger brackets there may be suspended one or more nail bags and one or more tools. The apparatus of the invention also encompasses a single belt loop tool holder which may form a part of the apparatus interchangeable on the belt worn by the user.

It is therefore among the objects the present invention to provide an improved nail/screw pouch apparatus and tool holder apparatus for use by a tradesman, affording convenience in use and efficiency and interchangability of a number of different items which might be used by the tradesman. These and other objects, advantages and features of the invention will be apparent from the following description of a preferred embodiment, considered along with the accompanying drawings.

DESCRIPTION OF THE DRAWINGS

FIG. 1 is a perspective view showing apparatus according to the present invention, including a pouch support member attachable to a belt, for receiving a plurality of nail/screw pouches or tool holders attachable to the support member.

FIG. 2 is a view in perspective showing a preferred embodiment of a pouch or bag for containing nails, screws, bolts or other items, including a snap hook for connecting to the pouch support member shown in FIG. 1.

FIG. 3 is a perspective view showing the pouch or bag of FIG. 2, but in a closed position.

FIG. 4 is a perspective view showing a tool holder which also has a snap hook for connection to the support member shown in FIG. 1, interchangeable with the pouches or bags.

FIG. 5 and 6 are front and side elevation views of a single belt loop tool holder usable in conjunction with the apparatus shown in FIG. 1–4.

DESCRIPTION OF PREFERRED EMBODIMENTS

In the drawings, FIG. 1 shows a belt-supported nail/-screw pouch and tool holding apparatus generally identified by the reference number 10.

The apparatus of the invention can include a belt 12, or the belt 12 can simply comprise the user's pants belt or any carpenter's belt of typical construction. Connected to the belt 12 is a pouch supporting member 14 which, as illustrated, preferably is engaged on the belt via a pair of vertically extending slots 16, with the belt passing through the slots as indicated. The pouch supporting member 14 may comprise a relatively stiff member which tends to remain in planar configuration, and it may be formed of a piece of leather. Near the bottom of the pouch supporting member 14 is a pouch hanger bracket or bar or rail 18 preferably configured as shown. The bracket or rail 18 may be formed of a metal bar, bent and formed into a configuration as shown or it can be formed of rigid plastic, as by molding.

In any event, the hanger bracket 18 has a generally horizontally extending main portion 20 which contains a plurality of dips or U-shaped sections 22 as shown. The hanger bracket may also include a pair of connecting legs 24, extending generally vertically upwardly as shown in FIG. 1, for securing the hanger bracket to the pouch supporting member 14. If the hanger bracket is mounted as shown in FIG. 1, it is important that the main horizontal portion 20 be spaced outwardly from the face of the flat pouch supporting member 14, so that hooks 26 (FIGS. 2–3) can be snapped over the bracket. The vertical legs 24 of the hanger bracket give torsional stability to the hanger bracket, in that it will not tend to any appreciable degree to tip the pouch support member 14 when carrying a load via the hooks 26 engaged in the U-shaped dips 22.

Alternatively, the pouch supporting member 14 can comprise a softer or more flexible sheet of material, with a hanger bracket depending from its bottom edge and in this way spaced from the sheet of material so as to receive the hooks (not shown). However, the construction illustrated in FIG. 1 is preferred, since a principal object of the invention is to enable the tradesman or user to quickly and easily snap the hooks 26 onto the main portion 20 of the hanger bracket, without requiring two hands and without even requiring the user's visual attention. It is therefore preferred that a relatively stiff backing member 14 be behind the bar section 20 over which the hooks are to be snapped.

FIGS. 2 and 3 show a preferred construction of a nail/screw pouch or bag 28 in accordance with the invention. As illustrated, the bag preferably is of a flexible material, such as woven nylon fibers (or other suitable fibers). It has an open mouth 30 at its upper end, and at one side (a back side) 32 of the open mouth there is preferably a relatively rigid rod 34 sewn in into the material or otherwise affixed thereto. The function of the rigid rod is in part to help hold the bag in an open position as shown, with the open mouth generally rectangular and providing ample opening space for the user to insert his hand. Another function of the rod is for securement to a lower or base end ring 35 of the snap hook 26.

The snap hook 26 may be of the type known of as "Caribbeaner," often used in sailing and mountain climbing. Such a hook has a hook-shaped upper end 36, with a spring biased snap closure member 38. It is a precision-made hook which offers little resistance to snapping over the bracket or bar 20 and which gives a good feel to the user when he snaps the hook over the bar. Alternatively, a simple "dog hook" can be used, which is generally similar but of somewhat cruder construction.

As also illustrated in FIGS. 2 and 3, the pouch or bag 28 is preferably formed with seams 40 at all corners, helping it to be relatively rigid when in the opened position shown in FIG. 2. There is also a hem 44 with doubled-over material at the outer side 46 of the open mouth of the bag, and this reinforcing means helps to keep this side of the open mouth from bunching or folding.

The bag or pouch 28 preferably has cooperating patches of "Velcro" material 48 and 50 on the two sides of the open mouth, as shown. The Velcro hook and loop fastener material is advantageous in enabling a quick and convenient closure of the top of the bag, requiring little attention of the user. The patches of Velcro material, stitched or adhered to the two sides of the mouth, also add some stiffness to each side, particularly the outer side 46, which, as discussed above, helps maintain the mouth in the wide open position and also helps in the closure of the bag's mouth, by tending to keep the Velcro edge in a flat, linear configuration.

FIG. 4 shows a tool holder 55. The tool holder, which may hold a pair of pliers, for example, as illustrated, has a snap hook 26 similar to those on the nail/-screw pouches or bags as discussed above. As such, the tool holder 55 is interchangeable with the bags on the hanger bracket or rail 18 of the assembly of the invention.

In use of the tool and nail/screw pouch holding apparatus of the invention, the tradesman or other user slides the pouch holder 14 on the belt 12, and there may be a series of pouch holders 14 secured to the belt. When at work on a job, the user picks appropriate bags from a tool box or other storage facility as needed for the particular task being undertaken. The bags or pouches form a very convenient storage medium for nails, screws, etc. whether on or off the belt. They may be used to store the items directly from the time of purchase. He simply orients the snap hook 26 of each item in the inwardly facing direction and snaps it onto the bar or hanger bracket 18. This can be done by feel alone, since there is no eye hole to feed the hook through, and since the hook can be located at any position along the horizontal length of the hanger bracket bar 20. The U-shaped dips 22 in the bar will eventually catch the snap hooks, one by one, and will keep them thus located and separated from each other.

When the user moves to a different operation, he can very easily remove one or more of the pouches and tool holders and quickly substitute different ones, as called for by the job.

FIGS. 5 and 6 show a single belt loop tool or bag holder 60 which may form a part of the apparatus described. The loop, preferably formed of a woven material such as Cordura nylon, has patches of Velcro hook and loop fastener material 62 and 64 on opposed faces of overlapping flaps **62*a* and 64*a* as shown. It may thus be easily placed over the user's belt 12, without removal of the belt. A bottom edge below the flap 64*a* is hemmed and stitched to hold a tool holder loop 66 as illustrated. The loop may hold a hammer or other tool, or it may hold a bag 28 snapped over the loop 66**, or even a tool and a small bag, if desired.

The above described preferred embodiment illustrates the principles of the invention but are not intended to limit the scope of the invention. Variations to this embodiment will be apparent to those skilled in the art and may be made without departing from the scope of the following claims.

I claim:

1. A belt-supported assembly for tradesmen, for hanging nails, screws or other items conveniently and accessibly from the belt, comprising, a pouch support having means for attachment to a belt worn by the user, and comprising a belt-attachable support member, with a rigid bar or rail secured to and extending generally horizontally along the support member, the rigid bar or rail including a plurality of depending U-shaped sections formed into the shape of the bar adaptéd each to receive and locate a hook placed on the bar, a series of storage pouches or bags for receiving and storing screws, nails or other items for access by the user, each pouch having secured to its upper end a closable hook means for snapping over the rigid bar and closing, and each pouch having an open mouth at its upper end for access by the user, with closure means for securing the open mouth to a closed position when desired.

2. The apparatus of claim 1, wherein the closure means of the pouch comprises cooperating patches of hook and loop fasteners on opposed sides of the open mouth of the pouch.

3. The apparatus of claim 1, wherein the pouch includes a generally rigid rod extending generally linearly through one side of the open mouth, with the closable hook means having a lower end secured around the rod in a generally central position.

4. The apparatus of claim 1, wherein the pouch is formed of flexible fabric material.

5. The apparatus of claim 3, wherein the pouch is formed of a flexible fabric material with the generally rigid rod encased in a loop of the fabric at the top of said one side of the open mouth.

6. The apparatus of claim 1, wherein the support member comprises a relatively stiff sheet of material, with the pouch hanger bar being secured to front face of the sheet of material such that it is spaced slightly away from the face of the sheet of material at the depending U-shaped sections and between said sections.

7. The apparatus of claim 6, wherein the support member comprises a sheet of leather, and wherein the pouch hanger bar has a pair of integral legs extending upwardly and generally perpendicularly at its ends, the hanger bar being secured to the leather support member by the two legs.

8. The apparatus of claim 1, further including a looped tool or pouch holder also attachable to the user's belt, comprising a flexible band of material of sufficient length to loop transversely around the user's belt and to overlap itself in a pair of overlapping ends, the overlapping ends having opposed hook and loop fastener material so as to be securable together to hold the flexible band on the belt, and including loop means secured to a bottom portion of the band for receiving either a closable hook means of a storage pouch, or a tool.

9. A belt-supported assembly for tradesmen, for hanging nails, screws or other items conveniently and accessibly from the belt, comprising, a pouch support having means for attachment to a belt worn by the user, and comprising a belt-attachable support member, with a loop means secured to and extending generally across the support member, the loop means adapted to receive hooks placed thereon, a series of storage pouches or bags of flexible material for receiving and storing screws, nails or other items for access by the user, each pouch having secured to its upper end a closable hook means for snapping over the loop means and closing, and each pouch having an open mouth at its upper end for access by the user, with closure means for securing the open mouth to a closed position when desired and with a generally rigid rod extending generally linearly through one side of the open mouth, with the closable hook means having a lower end secured around the rod in a generally central position, whereby the rigid rod connects the pouch structure to the closable hook means as well as holding one side of the open mouth straight to improve access to the pouch when in the open position.

* * * * *